US009182093B2

(12) United States Patent
Santiago et al.

(10) Patent No.: US 9,182,093 B2
(45) Date of Patent: Nov. 10, 2015

(54) GIMBALED CEILING LAMP

(71) Applicant: Evolution Lighting, LLC, Miami Lakes, FL (US)

(72) Inventors: Dwight D. Santiago, Summerfield, NC (US); Timothy J. Haubach, Allison Park, PA (US)

(73) Assignee: Evolution Lighting, LLC, Miami Lakes, FL (US)

( * ) Notice: Subject to any disclaimer, the term of this patent is extended or adjusted under 35 U.S.C. 154(b) by 78 days.

(21) Appl. No.: 14/185,354

(22) Filed: Feb. 20, 2014

(65) Prior Publication Data

US 2015/0176787 A1 Jun. 25, 2015

Related U.S. Application Data

(60) Provisional application No. 61/919,379, filed on Dec. 20, 2013.

(51) Int. Cl.

| | |
|---|---|
| ***F21V 14/02*** | (2006.01) |
| ***F21S 8/04*** | (2006.01) |
| ***F21K 99/00*** | (2010.01) |
| ***F21V 29/00*** | (2015.01) |
| ***F21V 17/06*** | (2006.01) |
| *F21Y 101/02* | (2006.01) |
| *F21W 131/30* | (2006.01) |

(52) U.S. Cl.

CPC . *F21S 8/046* (2013.01); *F21K 9/30* (2013.01); *F21V 14/02* (2013.01); *F21V 17/06* (2013.01); *F21V 29/22* (2013.01); *F21W 2131/30* (2013.01); *F21Y 2101/02* (2013.01)

(58) Field of Classification Search

CPC ..... F21S 8/046; F21S 8/043; F21K 9/30; F21V 29/22; F21V 14/02; F21V 14/00; F21V 21/04; F21V 21/043; F21V 21/14; F21V 19/02; F21V 17/00; F21V 17/02; F21V 17/04; F21V 17/06; F21V 17/10; F21V 17/12; F21Y 2101/02; F21W 2131/30

See application file for complete search history.

(56) References Cited

U.S. PATENT DOCUMENTS

| | | | | |
|---|---|---|---|---|
| 6,554,457 | B1 * | 4/2003 | Platt | 362/365 |
| 7,744,259 | B2 | 6/2010 | Walczak et al. | |
| 8,403,533 | B1 * | 3/2013 | Paulsel | 362/249.02 |
| 2006/0002136 | A1 * | 1/2006 | Buelow et al. | 362/581 |
| 2007/0103913 | A1 * | 5/2007 | Lin | 362/362 |
| 2014/0003061 | A1 * | 1/2014 | Chen et al. | 362/311.02 |
| 2014/0204574 | A1 * | 7/2014 | Ebisawa | 362/235 |

* cited by examiner

*Primary Examiner* — Bao Q Truong
(74) *Attorney, Agent, or Firm* — Greenberg Traurig, LLP

(57) ABSTRACT

A ceiling lamp consists of one or more LEDs supported by a housing that fits within a hemispherical framework that may be installed in a ceiling. The LED housing comprises a hemispherical heat sink that may be movably retained within the framework and may be rotated 360 degrees in the horizontal plane and downwardly in the vertical plane. The frame has one or more upwardly extending legs rigidly attached to a ceiling trim and that hold a circular ring positioned above the heat sink. An adjustment screw passes through a concave disc above the ring, and extends through the ring where it is attached to the hemispherical heat sink.

12 Claims, 3 Drawing Sheets

GIMBALED CEILING LAMP

CROSS REFERENCE TO RELATED APPLICATIONS

This application claims the benefit of U.S. Provisional Application Ser. No. 61/919,379 filed Dec. 20, 2013, the disclosure of which is hereby incorporated herein by reference in its entirety.

BACKGROUND OF THE INVENTION

Gimbaled ceiling lighting fixtures having a single plane of rotation are well known in the art. Such a gimbaled lamp consists of a fixed ceiling trim housing and a movable lamp housing in which the lamp housing will typically be supported on a horizontal axis attached to the ceiling trim, and passing through the approximate center of the lamp housing. In this configuration, the lamp housing may be rotated about the axis and is thereby able to be focused upon objects below the ceiling and within the plane of rotation. When it is desired to point the lamp at objects outside the plane of rotation, it may necessary to twist the ceiling trim housing within the ceiling cavity, or turn a rotatable element within the ceiling trim housing to orient the plane of rotation to intersect the object to be highlighted. Twisting or rotating the lamp may require removal of the trim or of the movable lamp housing, and may prove difficult or even impossible.

The situation is exacerbated when modern lighting that gives off a large amount of heat is used. Such lighting may include halogen incandescent bulbs or light emitting diodes (LEDs) that may be gathered in an array to provide sufficient lighting for the purpose, and may require a heat sink to conduct excessive heat away from the lighting element. One solution to the problem is provided by U.S. Pat. No. 7,744,259 to Walczak et al., in which a fixed heat sink having a concave hemispherical shape is attached to the ceiling trim, and a ball shaped array of LEDs is mounted adjustably within the heat sink. Heat generated in the LEDs is transferred to the heat sink which then radiates heat within the ceiling cavity. While this arrangement may permit omnidirectional focusing of the LED array, it is a large and bulky structure that takes up significant space within the ceiling cavity and may not be suitable for limited space environments. What is needed is a compact gimbaled ceiling lamp that can easily be pointed in any direction below the ceiling, and that does not require removal of the trim or lamp housing to accomplish such orientation.

SUMMARY OF THE INVENTION

A ceiling lamp consisting of one or more LEDs may be supported by a ceiling component that includes a concave hemispherical framework that extends above a ceiling trim flange. The one or more LEDs are mounted on a board that is contained within a hemispherical housing. The housing is rotatably retained within the framework and may be rotated 360 degrees in the horizontal plane of the ceiling and within a vertical plane below the ceiling. Heat is dissipated through the housing that comprises a hemispherical heat sink, and that is supported within the framework by an adjustment screw. The framework has one or more "legs" that are rigidly attached to the ceiling trim, and that hold a circular ring positioned above the heat sink and LEDs. The adjustment screw is held by, and passes through, a concave adjustment plate above the circular ring, extends through the ring, and is attached to the hemispherical heat sink. An adjustment nut on the adjustment screw, or some other adjustment mechanism, can tighten the heat sink against the framework, thereby creating a frictional interface that holds the heat sink and LED array in a desired orientation. By suitable adjustment of the amount of friction at the interface, the lamp housing may be oriented in any desired direction by hand.

The one or more LEDs may be chip-on-board (COB) technology in which a chip is mounted directly onto a printed circuit board. COB or any other technology may be used to provide lighting for the gimbaled ceiling lamp.

DETAILED DESCRIPTION OF THE PREFERRED EMBODIMENTS

Figure 1:
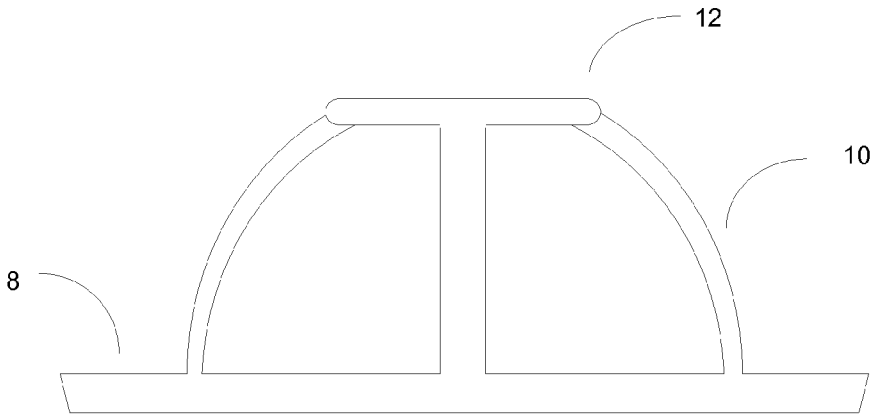
FIG. 1 is an elevational view of the ceiling component.

In FIG. 1, a ceiling component comprising a trim flange 8, a ring 12, and a framework 10, is shown in elevational view. The component fits into a ceiling cavity and the trim flange 8 remains below the cavity and is held against the ceiling. A framework 10 extends into the ceiling cavity. Attachment means (not shown) hold the trim flange 8 and framework 10, 12 within the cavity, and may be any well-known attachment mechanism.

Figure 2:
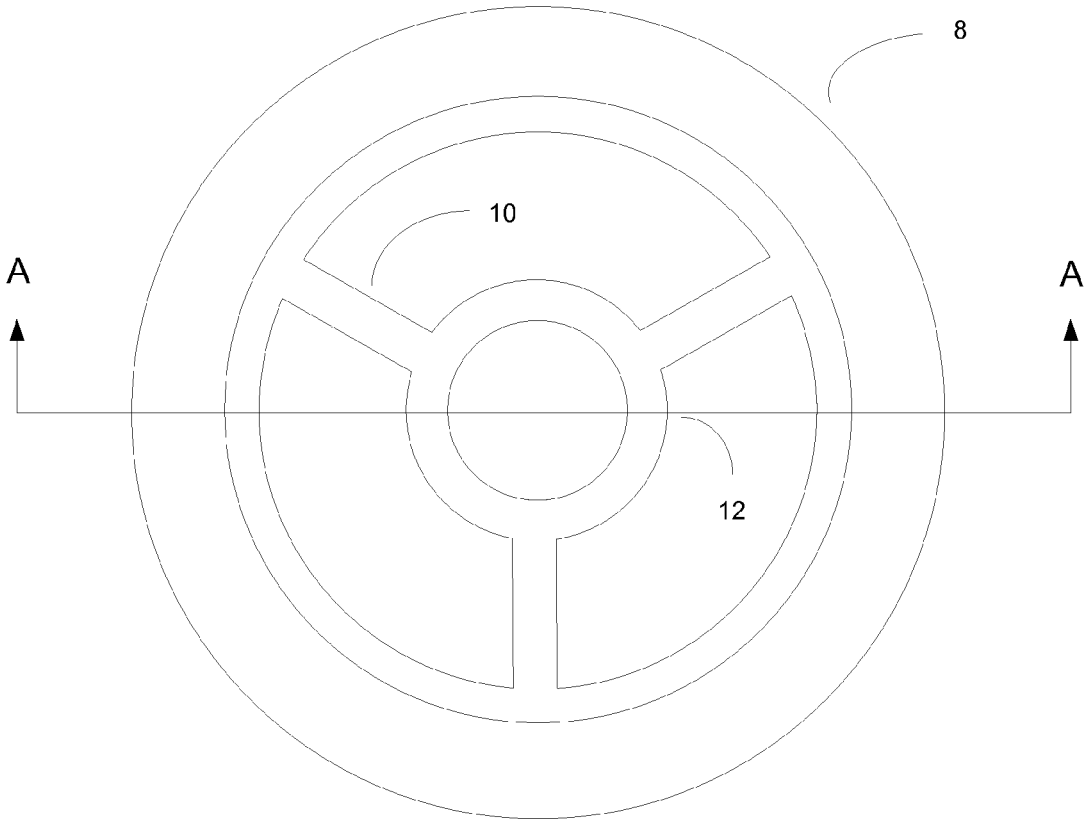
FIG. 2 is a plan view of the ceiling component.

FIG. 2 is a plan view of the trim flange 8 and framework having "legs" 10 and a ring 12 centered above the ceiling cavity. Although FIG. 2 shows a framework having 3 legs, the framework need not be so limited and may have but a single leg, or a plurality of legs sufficient to hold the ring 12 and support the lamp housing.

Figure 3:
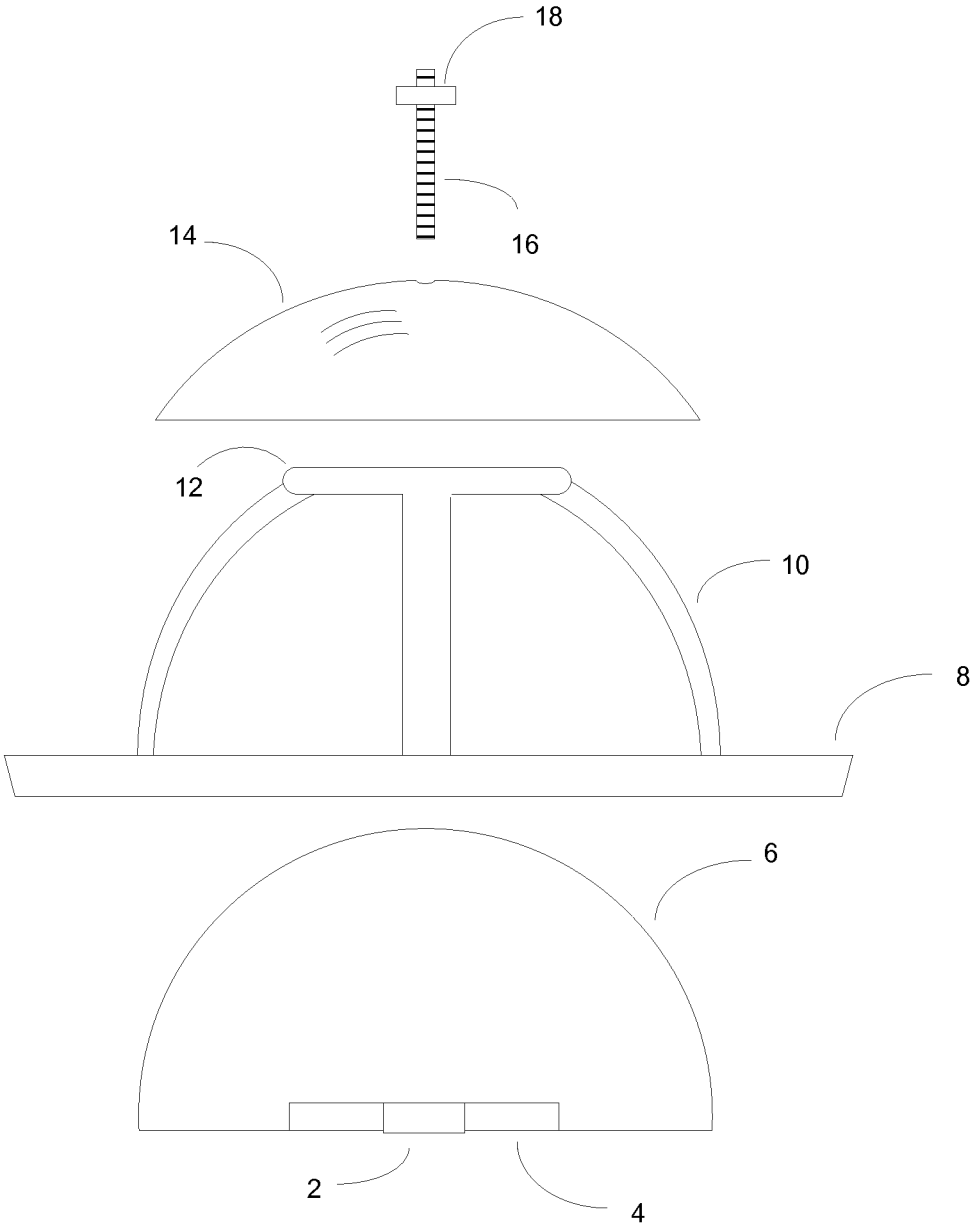
FIG. 3 is an exploded view of the gimbaled ceiling lamp.

FIG. 3 depicts a view of the gimbaled lamp in position to be assembled. The adjustment screw 16 and adjustment nut 18 extend through the adjustment plate 14, which is in the form of a concave disc. The concave disc 14 rests atop the framework consisting of legs 10 and ring 12. The framework is integrally attached to trim flange 8. Heat sink 6 serves as a housing for a printed circuit board (PCB) 4 on which is mounted one or more LEDs 2.

Figure 4:
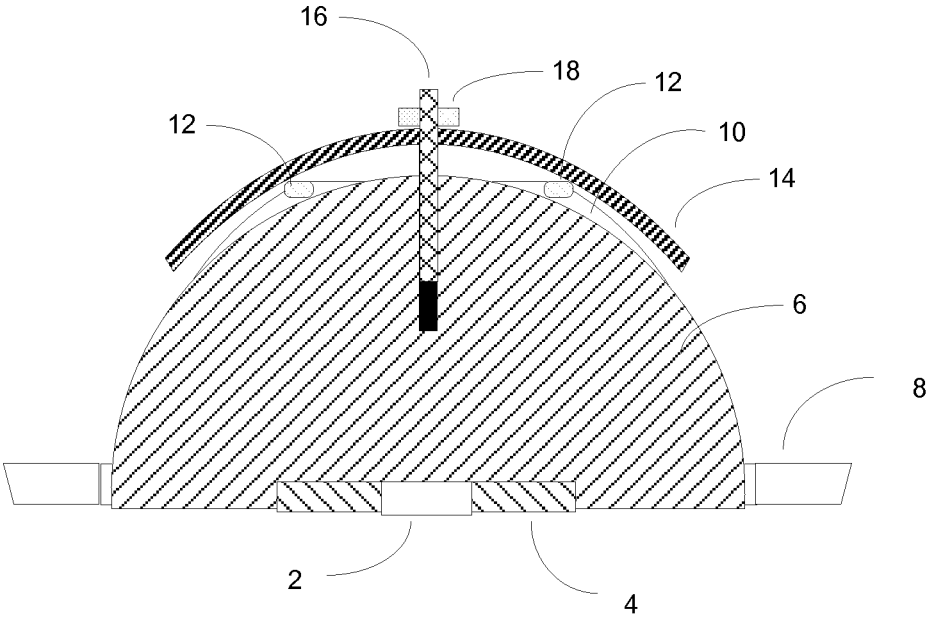
FIG. 4 is a cross-sectional elevational view of the gimbaled ceiling lamp taken across line A-A in FIG. 2 with a heat sink and LED array held in place with an adjustment screw.

FIG. 4 shows the assembled gimbaled ceiling lamp in a cross-section elevational view. Adjustment screw 16 is secured above adjustment disc 14 by adjustment nut 18. Adjustment disc 14 rests on ring 12, which is itself held in position by framework legs 10. Hemispherical heat sink/housing 6 is held within the framework 10, 12 by adjustment screw 16, and may be tightened against ring 12 by adjustment nut 18 as necessary to maintain a frictional interface. PCB 4 and one or more LEDs 2 are mounted against the flat side of heat sink 6.

Figure 5:
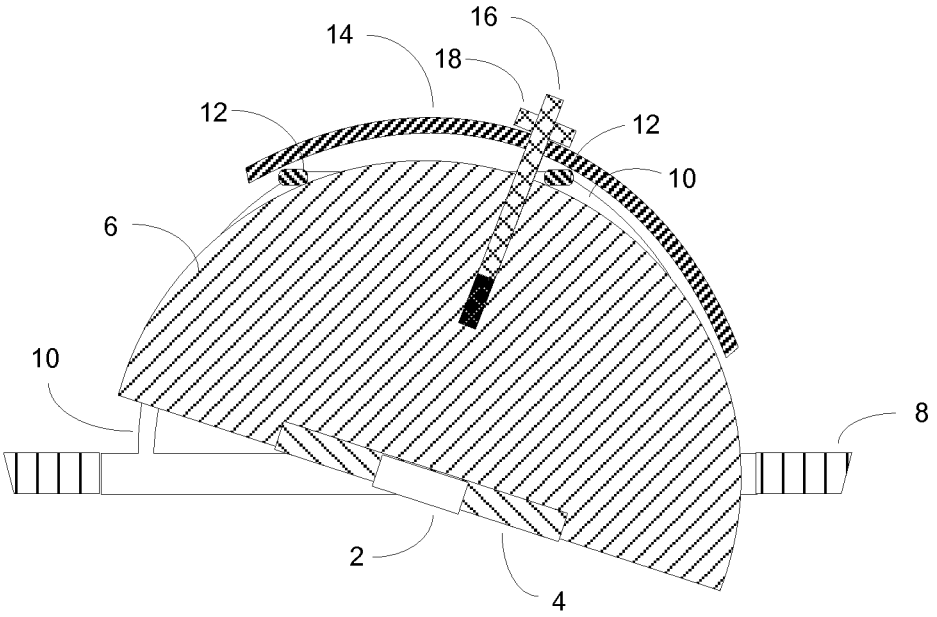
FIG. 5 is a cross-section elevational view of the gimbaled ceiling lamp of FIG. 4 shown with the LEDs pointed in an angled direction.

In FIG. 5, the gimbaled ceiling lamp of FIG. 4 is shown in an angled position whereby light from one or more LEDs 2 may be directed against objects below the ceiling. If necessary, adjustment nut 18 may be tightened as necessary to sustain the heat sink/housing 6 against undesired movement away from a desired position.

Although the invention has been shown and described in a preferred embodiment, the invention is not limited to the embodiments shown and described, and will be limited only by the scope of the claims to be appended hereto.

We claim:

1. A gimbaled ceiling lamp comprising:

A frame, a concave disc, a heat sink, and a light source;

said frame having a circumferential lower portion adapted to be affixed within a round ceiling cavity, and comprising one or more legs and a ring, said one or more legs extending upwardly and inwardly from said circumferential lower portion to support said ring above the approximate center of said circumferential lower portion;

said ring forming a support for holding said concave disc above said ring;

said heat sink being shaped to fit and rotate within said frame and below said ring, said heat sink supporting said light source affixed to a lower portion of said heat sink and being in surface contact with said light source such that heat generated by said light source is transferred to said heat sink;

said heat sink and said concave disc being connected by an elongate member extending from said concave disc through said ring and being joined to an upper portion of said heat sink;

whereby said heat sink and said light source may be rotated within said frame to direct light from said light source in any direction below said ceiling.

2. The gimbaled ceiling lamp as claimed in claim 1 wherein said light source further comprises one or more light emitting diodes.

3. The gimbaled ceiling lamp as claimed in claim 2, said one or more light emitting diodes being mounted on a printed circuit board.

4. The gimbaled ceiling lamp as claimed in claim 1 wherein said frame is substantially hemispherical in shape.

5. The gimbaled ceiling lamp as claimed in claim 4, said heat sink having an upper portion that is hemispherical such that said upper portion of said heat sink fits correspondingly within said substantially hemispherical frame.

6. The gimbaled ceiling lamp as claimed in claim 1 wherein said elongate member comprises a threaded screw.

7. The gimbaled ceiling lamp as claimed in claim 6 wherein said threaded screw is adjustable in one direction to increase friction between said heat sink, said ring, and said concave disc, and is adjustable in an opposite direction to decrease such friction.

8. The gimbaled ceiling lamp as claimed in claim 1 wherein said frame comprises three legs.

9. The gimbaled ceiling lamp as claimed in claim 8 wherein said ring is circular.

10. The gimbaled ceiling lamp as claimed in claim 9 wherein said concave disc has a circular perimeter and the diameter of said ring is smaller than the diameter of said concave disc.

11. The gimbaled ceiling lamp as claimed in claim 1 wherein said circumferential lower portion of said frame comprises a flange.

12. A gimbaled ceiling lamp comprising:

A heat sink having an upper exterior surface formed to fit movably within a concave frame and a lower surface adapted to support a light source;

said light source being removably attached to said lower surface of said heat sink and being in direct contact with said heat sink such that heat is transferred from said light source to said heat sink;

said concave frame being integrally connected to a circular trim flange and comprising a circular ring above said circular trim flange, and further comprising a plurality of supports extending upwardly to hold said ring above and centered upon said circular trim flange;

an adjustment plate comprising a concave surface, said adjustment plate being larger than the diameter of said ring and being attached to said upper exterior surface of said heat sink with a threaded screw whereby said threaded screw extends through said adjustment plate and said ring such that said heat sink is supported within said concave frame by said threaded screw and said adjustment plate;

whereby the distance between said adjustment plate and said heat sink is adjustable with said threaded screw such that said threaded screw may be tightened to create friction between said heat sink, said ring, and said adjustment plate.

* * * * *